US006264570B1

(12) United States Patent
Yoon

(10) Patent No.: US 6,264,570 B1
(45) **Date of Patent: *Jul. 24, 2001**

(54) PRACTICE SPORTS NET

(76) Inventor: Young W. Yoon, 127 Michael Mannor, Glenview, IL (US) 60025

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/148,525

(22) Filed: Sep. 4, 1998

(51) Int. Cl.[7] ..... A63B 69/36
(52) U.S. Cl. ..... 473/197; 373/400
(58) Field of Search ..... 473/197, 421, 473/454, 476, 478, FOR 104, FOR 212; 273/400, 181 F

(56) References Cited

U.S. PATENT DOCUMENTS

| | | | | |
|---|---|---|---|---|
| 3,001,795 | * | 9/1961 | Johnson, Jr. | 473/197 |
| 3,195,898 | * | 7/1965 | Respini | 473/197 |
| 3,698,712 | * | 10/1972 | Pero | 473/454 |
| 4,063,739 | * | 12/1977 | La Rose | 473/421 |
| 4,326,717 | * | 4/1982 | McClimon | 473/197 |
| 4,523,760 | * | 6/1985 | Bednarczuk | 473/421 |
| 5,269,527 | * | 12/1993 | Noval | 473/197 |
| 5,421,586 | * | 6/1995 | Amram et al. | 273/400 |

FOREIGN PATENT DOCUMENTS

| | | | | |
|---|---|---|---|---|
| 2485379 | * | 12/1981 | (FR) | 273/400 |
| 21909 | * | 10/1909 | (GB) | 273/181 F |

OTHER PUBLICATIONS

Original Home Driving Range; Hammacher Schlemmer Catalog, Summer, 1998; p. 3.

Child–Scaled Tennis Training Set; Hammacher Schlemmer Catalog, Summer, 1998; p. 4.

Triple Action Team Volleyball; Hammacher Schlemmer Catalog, Summer, 1998, p. 5.

Big–Mouth Net, The Golfsmith Store Catalog, Holiday, 1997; p. 2.

Pop–Up Practice Net, The Golfsmith Store Catalog, Holiday, 1997; p. 2.

Shag Net, The Golfsmith Store Catalog, Holiday, 1997; p. 2.

All–Sport Practice Net, Golf Day Catalog, Catalog 129C3; p. 3.

"Big Mouth" Portable Practice Net, Golf Day Catalog, Catalog 129C3; p. 3.

Indoor–Outdoor Practice Net, Golf Day Catalog, Catalog 129C3; p. 4.

Hitting Cage, Golfsmith Catalog, 1998; p. 3.

Fast Net, High Street Emporium Catalog, Summer, 1998; p. 3.

* cited by examiner

*Primary Examiner*—Mark S. Graham
(74) *Attorney, Agent, or Firm*—Price Heneveld Cooper DeWitt & Litton

(57) ABSTRACT

A portable practice golf driving net comprises a pair of vertically extending support poles formed from a plurality of articulating and interlocking segments. A top end of each of the support poles has a net support and a bottom end of each of the support poles has a pole support means. A substantially rectangular net has a top, bottom and side edges. Each of the side edges has a plurality of spaced apart retaining sleeves attached at vertical intervals thereto situated about a vertical length of one of the plurality of segments of the poles. The spaced apart retaining sleeves create a plurality of gaps, each of the gaps being in alignment and registration with mating ends of the segments of the poles, thereby allowing the pole segments to be attached and reattached to each other. An upper corner on each side of the net is attached to the net support and a lower corner of each side of the net is attached to the support pole proximate the pole support.

16 Claims, 3 Drawing Sheets

PRACTICE SPORTS NET

FIELD OF THE INVENTION

The present invention generally relates to a portable practice sports net. In particular, the present invention relates to a portable practice golf driving net having a pair of extendible support poles between which extends and by which is supported a net barrier extending from the ground to a significant height against which golf drives may practiced.

BACKGROUND OF THE INVENTION

Golf remains one of the most popular sports and recreational past times ever. Every year, millions of golfers devote significant energies, resources and time toward improving their score on the golf course. Such efforts can range from obtaining the latest technology in clubs and balls to obtaining professional golf lessons and instruction. However, possibly the biggest focus of most golfers is finding opportunities to actually practice their swings and techniques, particularly their drive or tee shots.

Unfortunately, obtaining such opportunities is often difficult and inconvenient. Clearly the most pleasurable method is to actually play a round of golf on a golf course. This requires significant time and, in many cases, money. Other times, it is more convenient or desirable to frequent so-called driving ranges, where the golfer can repeatedly practice drive or tee shots from a driving station. Again, although consuming far less time and money than a full round of golf, driving ranges also suffer from the limitations of access and availability to many golfers.

Solutions to this problem have been proposed through the years. One solution has been the development of frame and net structures that can be used at or near the golfer's home. Such nets typically include a circular or square frame forming a periphery to which is attached a mesh or net material. Such frames usually comprise a set of interlocking right-angle poles that, when fully assembled, form a rectangular shape across which a screen or net is a positioned and into which a golf ball may be driven. Such frames, however, are usually fairly expensive and complex to assemble, particularly alone. Also, the loss of even a single pole segment renders the entire net useless. Such nets further typically consume significant storage space when not in use. Other frames comprise self-erecting flexible rings that can be folded upon themselves and which are attached about their periphery to a net or mesh. Although easier to deploy, such frames likewise consume significant space and are typically smaller when deployed and hence of lower utility.

For the foregoing reasons, an unresolved need exists for an improved portable practice sports net.

SUMMARY OF THE INVENTION

To overcome these and other disadvantages of the prior art, the present disclosure, briefly described, provides, in general form, an improved practice golf driving net into which golf balls may be conveniently driven comprising a pair of vertically extending support poles preferably consisting of three articulating and interlocking segments. The segments are preferably detachably connected together via a shock cord extending through each of the segments. A top end of each of the poles has a net support and a bottom end of each of the poles has a pole support means.

A substantially rectangular net has a top, bottom and side edges, where each of the side edges preferably have three spaced apart retaining sleeves attached at vertical intervals thereto. Each of the sleeves is situated about a vertical length of one of the three segments of the poles, where the spaced apart sleeves create a gap at mating ends of the segments of the poles, thereby allowing the pole segments to be attached and reattached to each other without interference from the sleeves that maintain the net in taut relationship with the poles. An upper corner at each side of the net is attached to the net support and a lower corner of each side of the net is attached to the pole proximate the pole support.

Thus, the net of the present invention can be readily assembled and disassembled, while providing a net that is relatively taut, but yielding, when hit by a golf ball. For example, the sleeves are connected to the poles about each of the segments and spaced apart such that each of the interconnecting portions of the pole segments are exposed and can be pulled away from its adjacent segment without interference.

There are of course additional features of the disclosure that will be described hereinafter which will form the subject matter of the claims appended hereto. In this respect, before explaining the several preferred embodiments of the disclosure in detail, it is to be understood that the disclosure is not limited in its application to the details of the construction and arrangements set forth in the following description of illustrated in the drawings. The improved sport net of the present disclosure is capable of other embodiments and of being practiced and carried out in several ways. Also, it is to be understood that the phraseology and terminology employed herein are for description and not limitation.

As will appear from the detailed description of the preferred embodiment to follow, the features of the sports net render it suitable for a wide variety of conditions and uses. In addition to the convenience of rendering a practice sports net readily available and thereby allowing a golfer to more frequently practice their golf skills, the practice sports net of the present invention offers a relatively inexpensive and easily stored net that can be readily manipulated by a single person.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto.

In this respect, before explaining the preferred embodiment of the disclosure in detail, it is to be understood that the disclosure is not limited in its application to the details of the construction and the arrangements set forth in the following description or illustrated in the drawings. The improved sports net of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

Therefore, it is the primary object of the present invention to provide a new practice sport net, and particularly a practice golf driving net, that is easily assembled and disassembled.

It is a further object of the present invention to provide a new practice sports net that consumes a minimal space when not in use.

It is another object of the present invention to provide a new practice sports net that, when a used as a practice golf driving net provides a taut surface into which a golf ball may be driven yet acts to deaden the travel of such golf ball so that the golf ball immediately drops to the ground upon impacting the net.

It is yet an additional object of the present invention to provide a new sports net that is relatively inexpensive to produce and to maintain.

These and other objects, along with the various features and structures that characterize the invention, are pointed out with particularity in the claims annexed to and forming a part of this disclosure. For a better understanding of the practice net of the present disclosure, its advantages and the specific objects attained by its uses, reference should be had to the accompanying drawings and descriptive matter in which there are illustrated preferred embodiments of the invention.

While embodiments of an improved sports net are herein illustrated and described, it is to be appreciated that various changes, rearrangements and modifications may be made therein, without departing from the scope of the invention as defined by the appended claims.

BRIEF DESCRIPTION OF THE FIGURES

The disclosure of the identification system for cleaning articles is explained with illustrative embodiments shown in the accompanying drawing, where.

DETAILED DESCRIPTION OF THE PREFERRED EMBODIMENT

Figures 1, 3:
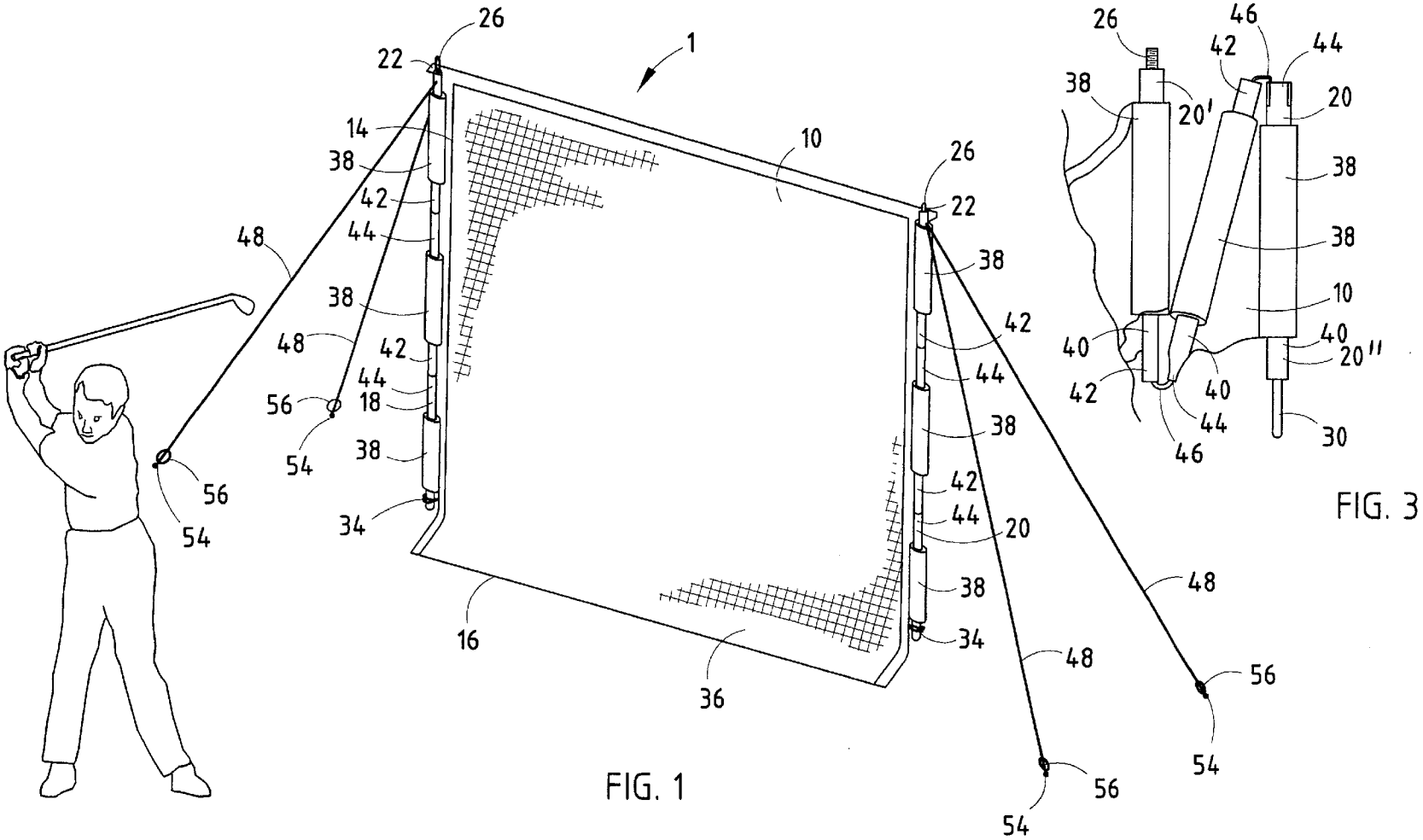
FIG. 1 is a perspective view of the preferred embodiment of the present invention.
FIG. 3 is a perspective view of the preferred embodiment of the present invention in its folded condition.

The best mode for carrying out the invention is presented in terms of the preferred embodiment, wherein similar reference characters designate corresponding features throughout the several figures of the drawings.

Referring now to the drawings, particularly FIG. 1, there is shown the portable practice golf driving net 1 of the present invention. The net 1 is generally formed of a mesh-type netting fabric 10 made from any natural or synthetic fiber, such as nylon. The mesh preferably has openings of about 0.25 inch. An upper finished edge 12 and side finished edges 14 define the upper and side edges of the net fabric 10 and provide a relatively strong and convenient location for support of the net, as discussed in further detail below. The bottom edge 16, being a non-load bearing structure, is preferably unfinished, but can be finished if desired. Overall, the netting fabric 10 is about 10 feet across, and as shown in FIG. 1, about 7 feet in overall height.

The portable practice golf driving net 1 is supported via support poles 18, 20 positioned on either side of the net 1 proximate each of the side edges 14. An upper end 18', 20' of each of the support poles 18, 20 engages on either side of the net 1 a support tab 22 extending beyond and from the top finished edge 12. The tab 22 is provided with a grommet 24 extending therethrough, preferable formed from metal, into which a threaded shank 26 is received. Threaded shank 26, formed at and extending upwardly from the upper end 18', 20' of each of the support poles 18, 20, is positively attached to the tab 22, preferably via a threaded fastener such as nut 28 shown in FIG. 5.

A peg 30 extends from each bottom end 18", 20" of each of the support poles 18, 20 and can be driven into the ground when the net 1 is used outdoors to support the net 1. Preferably, the pegs 30 are about 5 inches long, Where the net practice golf driving net 1 of the present invention is used indoors, a weighted anchor foot (not shown) adapted to receive the pegs 30 can be provided to support the net 1. Of course, the pegs 30 can also be inserted into corresponding holes in the floor, such as in a basement, to support net 1.

Located near the bottom end 18", 20" of each support pole 18, 20 is a retaining loop 32 fixedly attached to each of the side edges 14 of the net 1. A retaining strap 34, preferable made of a bungie cord type of material, is stretched and looped through the retaining loop 32 and around the bottom end 18", 20" of the support poles 18, 20 to retain the lower portion 36 of the net fabric 10 proximate the support poles 18, 20. As best shown in FIG. 1, the resulting configuration preferably results in the bottom edge 16 and lower portion 36 of the netting fabric 10 resting upon the ground facing the golfer, which tends to encourage golf balls impacting the net 1 to roll back toward the golfer. Fixedly attached to each of the side edges 14 are a series of retaining sleeves 38 arranged in regular intervals along the vertical edge of the netting fabric 10. There are preferably three such retaining sleeves 38 positioned along each side edge 14.

Each of the support poles 18, 20 is comprised of a plurality (preferably three) of articulating and interlocking segments 40 having mating ends 42, 44. The interior diameter of mating end 42 is larger than the exterior diameter of mating end 44 and receives end 42 therein to positively connect the segments 40. A shock cord or chain 46, as is known in the art, continuously extends through each segment 40 of the support poles 18, 20 from the top end 18', 20' to the bottom end 18", 20" to maintain the segments 40 attached one to the other and to keep the segments 40 of the support poles 18, 20 readily available.

Figure 2:
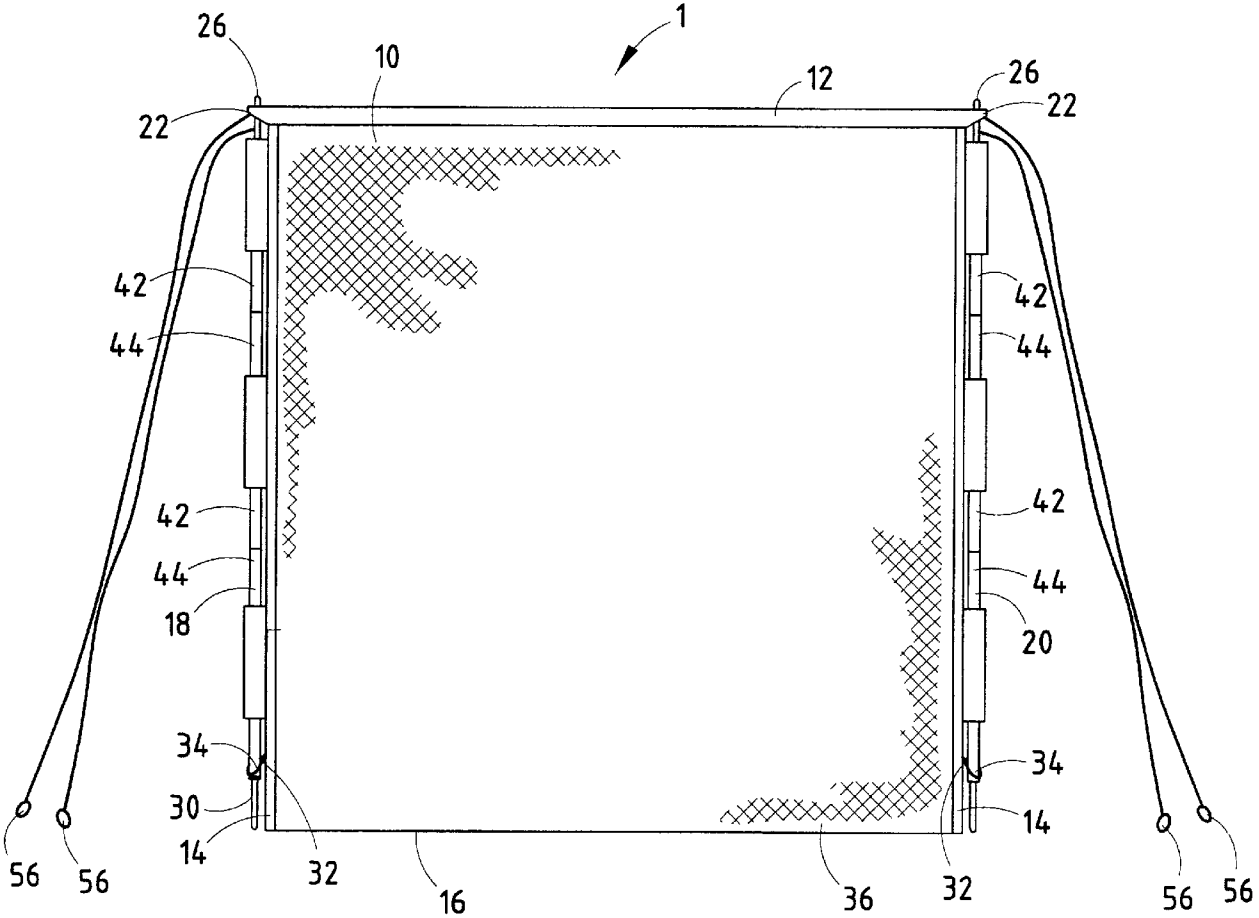
FIG. 2 is an front elevation view of the preferred embodiment of the present invention.
Figure 7:
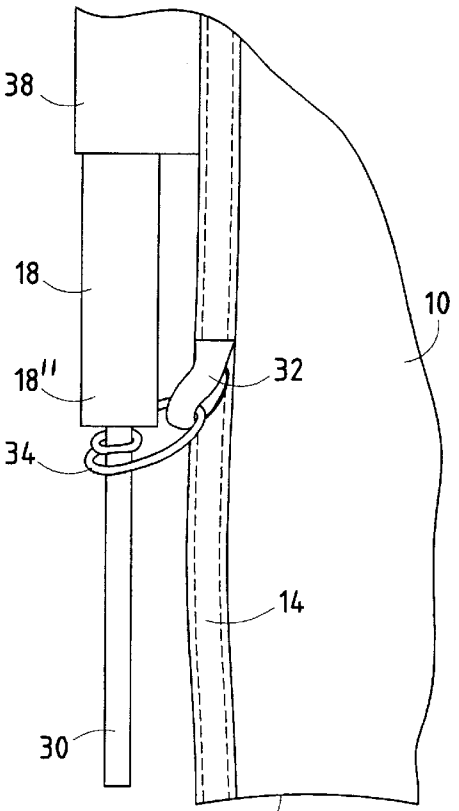
FIG. 7 is a partial view of the pole support of the preferred embodiment of the present invention.

Thus, as show in FIGS. 1 and 2, the mating ends 42, 44 are located at the midpoint between each of the retaining sleeves 38 in an spaced interval whereat the mating ends 42, 44 of each of the support poles 18, 20 are readily available for manipulation and assembly/disassembly. Preferably, each of the retaining sleeves 38 is positioned at the midpoint of each of the segments 40.

Figure 5:
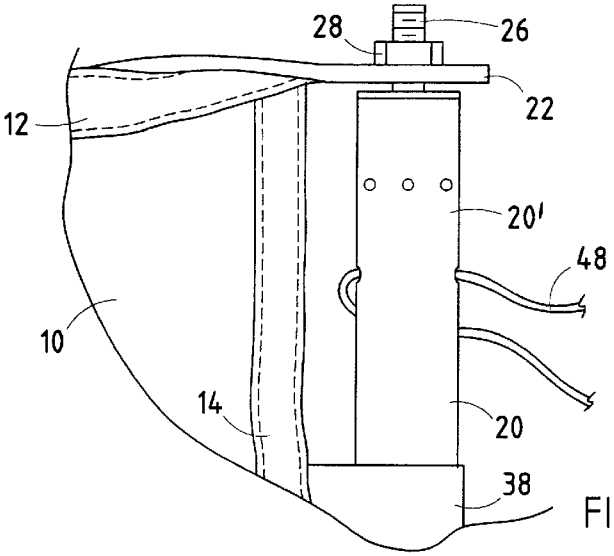
FIG. 5 is a partial elevation view of the net support of the preferred embodiment of the present invention.
Figure 6:
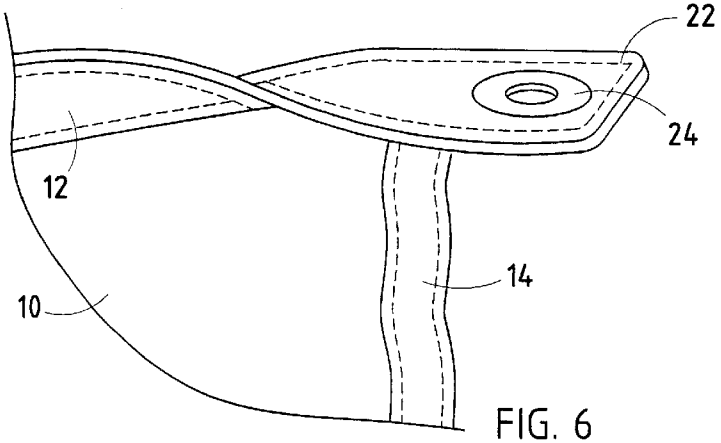
FIG. 6 is a perspective view of the net support of the preferred embodiment of the present invention.

As generally shown in FIGS. 1 and 2, and shown in detail in FIG. 5, tether lines 48 extend from the upper end 18', 20' of the support poles 18, 20 to anchor the net 1 via ground stakes 54 via ends 56 at locations oblique to the plane of the net 1.

Figure 4:
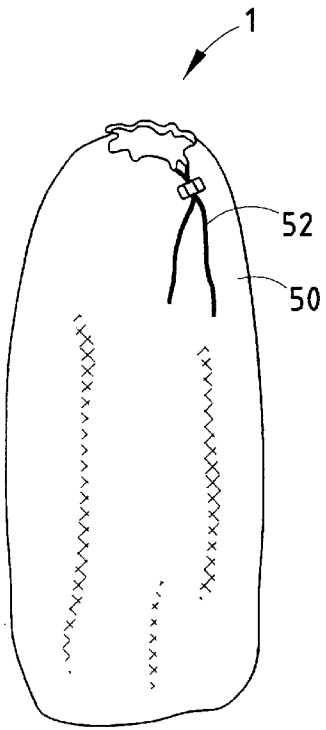
FIG. 4 is a perspective view of an preferred embodiment of the present invention in a folded condition and inserted into its storage bag for ready transport or storage.

The steps required to set up or compact the preferred embodiment of the practice golf driving net of the present invention are fairly straightforward and easily accomplished by a single person. Initially, as shown in FIG. 4, the net 1 of the present invention is conveniently stored in a bag 50 having drawstring 52. The net 1 is removed from the bag 50 and, as shown in FIG. 3, is unrolled to reveal each of the two folded support poles 18, 20. Once unrolled, each segment 40 of the support poles 18, 20 are aligned one to the other and mating ends 44 are inserted into mating end 42 for each of the segments 40 to form the assembled support pole 18, 20 and thereby expand and deploy the netting fabric 10 attached to each of the segments 40 by the retaining sleeves 38. Since the tab 22 and retaining loop 32 are permanently attached to the upper end 18', 20' and bottom end 18", 20" of the support poles 18, 20, respectively, the net 1 is at that point virtually assembled. The pegs 30 of each of the support poles 18, 20 are then pushed into the ground such that the netting fabric 10 is substantially in tension. Once supported, the tether lines 48 are tautly attached to stakes 54 at ends 56 to further anchor the net 1.

To disassemble the portable practice golf driving net 1, the aforementioned steps are reversed. A particularly advantageous feature of the present invention is that the retaining sleeves are spaced along the side edge 14 in spaced apart intervals. This feature allows the mating ends 42, 44 of the each of the support poles 18, 20 to be firmed grasped and separated without interference from the retaining sleeves 38. For example, as the mating segments 40 are separated, the two proximate retaining sleeves 38 can slide along the segment 40 away from the mating edges 42, 44 and allow the segments 40 to further separate and articulate one relative the other. Thus done from each of the mating ends 42, 44, the assembly again resembles that shown in FIG. 3. One of the support poles 18, 20 is then rolled along the netting fabric 10 toward the other support pole 18, 20 to obtain a compact, relatively small package that can again be inserted into storage bag 50 and retained by drawstring 52. Preferably, the resulting package is a cylindrical bag merely 6 inches wide and 28 inches long, that is easily transported and stored.

The objects of the invention have thus been attained in an economical, practical, and facile manner. While preferred embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

What is claimed is:

1. A practice sports net consisting essentially of:

a pair of vertically extending support poles comprising a plurality of articulating and interlocking segments, a top end of each of the poles having a net support comprising an upwardly extending threaded shank and a bottom end of each of the poles having a pole support, the pole segments being attached one to the other at interlocking mating ends provided on each segment, a first segment mating end having a reduced diameter relative an adjacent second segment end such that the first segment end can be inserted into the adjacent second mating segment end, the segments of each pole being permanently attached one to the other via a shock cord extending therethrough;

a substantially rectangular net having a top, bottom and side edges, each of the side edges having a plurality of regularly spaced apart retaining sleeves attached at vertical intervals thereto, each of the retaining sleeves situated about a respective vertical midpoint along the length of each of the plurality of segments of the poles, the mating ends of the plurality of segments of the poles being exposed and disposed at the midpoint between each of the retaining sleeves in regular intervals wherein the mating ends of the plurality of segments of the poles are readily available for manipulation and assembly and disassembly, an upper corner at each side edge of the net permanently attached to the threaded shank of the net support through threaded fasteners and a lower corner of each side edge of the net fixedly attached to the pole proximate the pole support.

2. The practice sports net of claim 1, wherein the spaced apart retaining sleeves create a plurality of gaps, each of the gaps being in alignment and registration with mating ends of the segments of the poles thereby allowing the pole segments to be attached and reattached to each other.

3. The practice sports net of claim 1, wherein each of the support poles are comprised of three pole segments.

4. The practice sports net of claim 1, wherein the net support comprises a grommet disposed in a retaining tab at each upper corner of the net inserted over the threaded shank shouldered onto the top end and upon which a threaded nut is affixed.

5. The practice sports net of claim 1, wherein the pole support is a shank attached to a bottom end of each of the poles for insertion into the ground.

6. The practice sports net of claim 1, wherein the sleeves are spaced apart in equal intervals corresponding to the length of each segment.

7. The practice sports net of claim 1, wherein the net extends from the net support to the pole support.

8. In combination with a portable practice golf driving net having a substantially rectangular netting panel having a top, bottom and side edges, each of the side edges having a plurality of spaced apart retaining sleeves attached at vertical intervals thereto and situated about a pair of vertically extending independent support poles formed from a plurality of interconnected, articulating and interlocking segments having mating ends, the mating ends of the segments being exposed and disposed at the midpoint between each of the retaining sleeves in regular intervals wherein the mating ends of the segments are readily available for manipulation and assembly and disassembly, the poles being permanently attached one to the other via a shock cord extending therethrough, a top end of each of the poles having a net support comprising a threaded upwardly extending shank and a bottom end of each of the poles having a pole support and an upper corner at each side edge of the net permanently attached to the threaded shank of the net support and a lower corner of each side edge of the netting panel fixedly attached to the pole proximate the pole support.

9. The combination of claim 8, wherein said support poles are each approximately seven feet in vertical height and the netting panel extends from the top of each support pole to the bottom of the support pole.

10. The combination of claim 8, wherein the spaced apart retaining sleeves create a plurality of gaps each in alignment and registration with mating ends of the segments of the poles.

11. The combination of claim 8, wherein each of the support poles are comprised of three pole segments and each side edge is provided with three corresponding retaining sleeves positioned approximately at a midpoint of each of the segments.

12. The combination of claim 8, wherein a pair of tether lines is attached to each of the support poles proximate the net support and extended obliquely to a ground stake anchor.

13. The combination of claim 9, wherein the netting panel extends beyond the bottom of the support pole to lay on the ground before the netting panel.

14. The combination of claim 8 further comprising a shank attached to a bottom end of each of the poles for insertion into the ground.

15. The combination of claim 8 further comprising a retaining loop attached to the side edge proximate each lower corner of the netting panel through which is passed a retaining cord further attached to the bottom of each of the support poles.

16. A portable sports device comprised of a substantially rectangular netting panel having a top, bottom and side edges, each of the side edges having a plurality of regularly spaced apart retaining sleeves attached at vertical intervals thereto and situated about a vertical midpoint along the length of a segment of a pair of vertically extending independent support poles formed from a plurality of interconnected, articulating and interlocking segments, the segments of each of the pair of poles being attached one to the other via a first segment mating end having a reduced diameter relative to the diameter of a second adjacent segment mating end and each segment being permanently attached one to the other via a shock cord extending therethrough, the mating ends of the segments of the poles being exposed and disposed at the midpoint between each of the retaining sleeves in regular intervals wherein the mating ends of the segments of the poles are readily available for manipulation and assembly and disassembly, a top end of each of the poles having a net support comprising a threaded shank and restraining fastener and a bottom end of each of the poles having a pole support and an upper corner at each side edge of the netting panel permanently attached to the net support and a lower corner of each side edge of the netting panel fixedly attached to the pole proximate the pole support.

* * * * *